US007121419B2

(12) United States Patent
Ferry et al.

(10) Patent No.: US 7,121,419 B2
(45) Date of Patent: Oct. 17, 2006

(54) CLOSURE

(75) Inventors: Andrew Ferry, Stirlingshire (GB); James McLennan, Fife (GB); David Senior, Perthshire (GB); John Sharpe, Scotland (GB)

(73) Assignee: Crown Obrist GmbH, Reinach (CH)

( * ) Notice: Subject to any disclaimer, the term of this patent is extended or adjusted under 35 U.S.C. 154(b) by 337 days.

(21) Appl. No.: 10/473,154

(22) PCT Filed: Mar. 28, 2002

(86) PCT No.: PCT/EP02/03482

§ 371 (c)(1),
(2), (4) Date: Sep. 29, 2003

(87) PCT Pub. No.: WO02/085730

PCT Pub. Date: Oct. 31, 2002

(65) Prior Publication Data

US 2005/0258128 A1 Nov. 24, 2005

(30) Foreign Application Priority Data

Apr. 20, 2001 (EP) ..... 01303665

(51) Int. Cl.
*B65D 49/12* (2006.01)

(52) U.S. Cl. ..... 215/258

(58) Field of Classification Search ..... 222/153.06; 215/249, 250, 253, 324, 258, 252; 220/265, 220/266, 309.1, 309.2
See application file for complete search history.

(56) References Cited

U.S. PATENT DOCUMENTS 1,798,151 A * 3/1931 Fabrice ..... 215/258
3,348,718 A * 10/1967 Musy ..... 215/252
3,455,479 A * 7/1969 Wilton et al. ..... 215/258
3,810,556 A * 5/1974 Coursaut ..... 215/257
4,569,464 A 2/1986 Wassilieff
4,744,480 A * 5/1988 Luch et al. ..... 215/252
5,004,126 A 4/1991 Klesius
5,445,824 A * 8/1995 Someya ..... 424/520
5,603,422 A * 2/1997 Herrmann ..... 215/256
6,095,375 A 8/2000 Adams et al.

FOREIGN PATENT DOCUMENTS

| | | |
|---|---|---|
| DE | 31 49 780 A1 | 6/1983 |
| DE | 3906164 A1 | 9/1990 |
| DE | 20019797 U1 | 4/2001 |
| EP | 0306670 A1 | 7/1988 |
| EP | 0385014 A1 | 1/1990 |
| EP | 1065150 A1 | 1/2001 |
| GB | 2136782 A | 9/1984 |
| GB | 2264110 B1 | 8/1993 |
| WO | WO 02/44047 A1 | 6/2002 |

* cited by examiner

*Primary Examiner*—Philippe Derakshani
(74) *Attorney, Agent, or Firm*—Diller, Ramik & Wight

(57) ABSTRACT

The combination of a closure (110) and an in-bore fitment (201) is provided for a container. The closure (110) comprises a generally plain crown (120) with a tubular skirt (130) depending from its periphery. The tubular skirt (130) has a first weakened zone (140) defining a first tamperevident portion (150); the first weakened zone (140) is adapted to break on first opening of the container. The tubular skirt (150) has a second weakened zone (190) defining a second tamperevident portion (150). The second weakened zone (190) is protected from breakage on first opening of the container but is arranged to break if an attempt is made to remove the in-bore fitment (201) from the container.

16 Claims, 3 Drawing Sheets

CLOSURE

BACKGROUND OF THE INVENTION

The present invention relates generally to a closure for a container, and particularly to a closure of the type comprising a generally plain crown with a tubular skirt depending from the periphery thereof. An example of this type of closure is a metal (such as aluminium) shell, most commonly used as a closure for bottles containing spirits.

In general the tubular skirt of this type of closure has a circumferential line of weakening which defines a break band. The break band is in some way secured to the bottle, for example by rolling part of it under the bottle transfer bead, so that when the closure is first opened it is split along the line of weakening. The uppermost part of the closure then serves as a cap for reclosing the bottle and the break band is retained on the bottle. The top cap and lower break band are irreversibly separated and this provides visual evidence that the bottle has been opened.

An example of such a closure is shown in FIG. 1. The closure (10) comprises a generally plain crown (20) with a tubular skirt (30) depending from the periphery thereof. The tubular skirt (30) has a circumferential line of weakening (40) which divides the closure into an upper top cap (45) and a lower tamperevident break band (50).

In many cases, and particularly in bottles for spirits, an in-bore fitment such as a non-return fitment is provided. The non-return fitment (not shown) can be secured within the closure (10) by four circumferentially spaced retaining dimples (80) which extend into a retaining channel of the fitment. The fitment may be held in a bottle by turning the free end (31) of the closure skirt (30) under the transfer bead of the bottle neck and/or by retaining fins present on the fitment which jam it into the bottle neck. As such, when the top cap (40) is rotated to open the bottle, the skirt (30) breaks along the line of weakening (40) so that the cap (40) is removed. The lower break band (50) remains in place on the bottle neck, held by its connection to the fitment and by the turned under free end (31). If the fitment is removed, which may be the case if unwanted refilling of the bottle is attempted, the lower break band is generally unaffected.

Whether or not the lower break band is removed with the non-return fitment there is no visible evidence that the fitment has been removed, other than perhaps the presence or absence of the break band. The present invention seeks to address the lack of such a secondary tamperevident feature.

Document DE 3906164 describes a plastic closure with an upper tear band and a lower break band. The tear band must be removed before a top cap can be unscrewed. The break band breaks if a lower cap, which retains a pouring fitment, is removed.

SUMMARY OF THE INVENTION

Accordingly there is provided a closure and an in-bore fitment for a container, the closure comprising a generally plain crown with a tubular skirt depending from the periphery thereof, the tubular skirt having a first weakened zone defining a first tamperevident portion and adapted to break on first opening of the container, the fitment is secured within the bore of the container by the closure, characterised in that, the tubular skirt has a second weakened zone defining a second tamperevident portion axially spaced from the first tamperevident portion, at the free end of the skirt, the second weakened zone is protected from breakage on first opening of the container but is arranged to break on attempted removal of the fitment from the container.

By providing the second weakened zone and protecting it from breakage upon first opening the present invention provides a secondary tamperevident feature. The second weakened zone is unaffected by normal opening and closing of the container but is broken in response to removal of, or preferably simply an attempt to remove, the fitment.

The closure may be formed from metal, although it will be appreciated that this is not essential for the working of the invention. Other materials such as plastics may also therefore be used.

In a preferred embodiment the first and second weakened zones are formed by a circumferential line of weakening. Other forms of weakening, such as longitudinal lines of weakening, are not beyond the scope of the invention and all that is required is a frangible connection between adjacent parts.

The second tamperevident portion may be adapted to be secured to the container. The second portion may be secured for example by turning the free end of the skirt under a projecting rim of the container, such as the transfer bead of a bottle neck. It may be preferred that the second portion is permanently secured to the container to prevent removal and refitting of a completely new closure.

The first and/or second tamperevident portion may be a circumferential band.

The first and second tamperevident portions may be prevented from separation on first opening by securing the first tamperevident portion to the fitment; this prevents axial movement independently thereof.

The second weakened zone may be adapted to break by securing the second tamperevident portion to the container. In a preferred embodiment the second tamperevident portion is restrained from movement but the second weakened zone is not protected from breakage if the fitment is removed.

The present invention will now be more particularly described, by way of example, with reference to the accompanying drawings, in which:

DETAILED DESCRIPTION OF THE PREFERRED EMBODIMENTS

Figure 1:
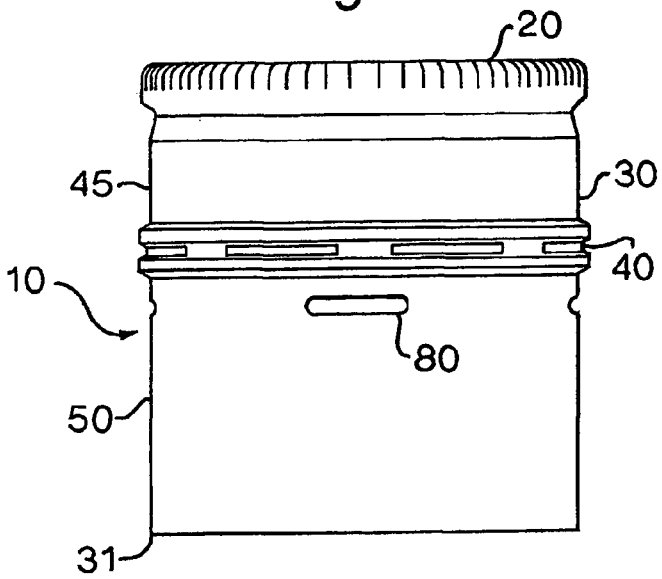
FIG. 1 is a side view of a prior art closure.
Figure 2:
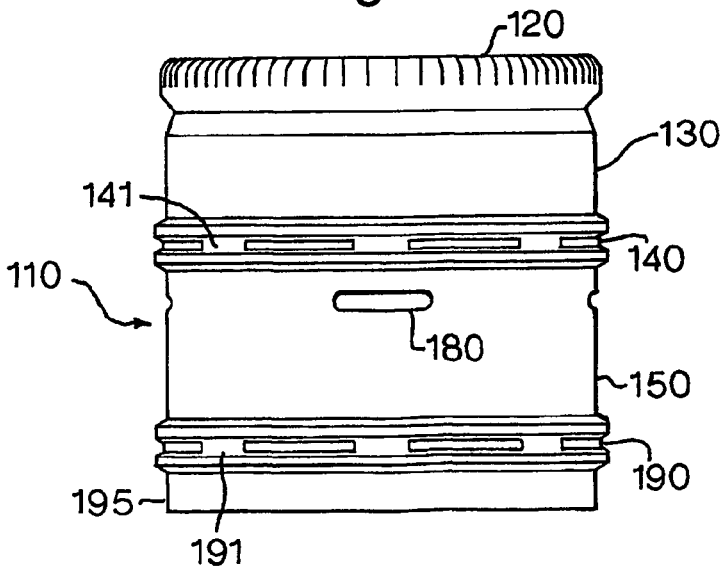
PRIOR ART Fig.2.
FIG. 2 is a side view of a closure according to the present invention.

Referring to first to FIG. 2 there is shown a closure 110 comprising a generally plain crown 120 with a tubular skirt 130 depending from the periphery thereof. The tubular skirt 130 has a first circumferential line of weakening 140 which frangibly connects an upper top cap 145 and a first tamperevident break band 150. Four circumferentially spaced retaining dimples 180 are provided at the top of the first tamperevident portion 150. The tubular skirt 130 has a second circumferential line of weakening 190 below the first circumferential line of weakening 140. The second circumferential line of weakening 140 defines a second tamperevident break band 195. The circumferential lines of weakening 140, 190 comprise a plurality of circumferentially spaced frangible bridges 141, 191.

Figure 3:
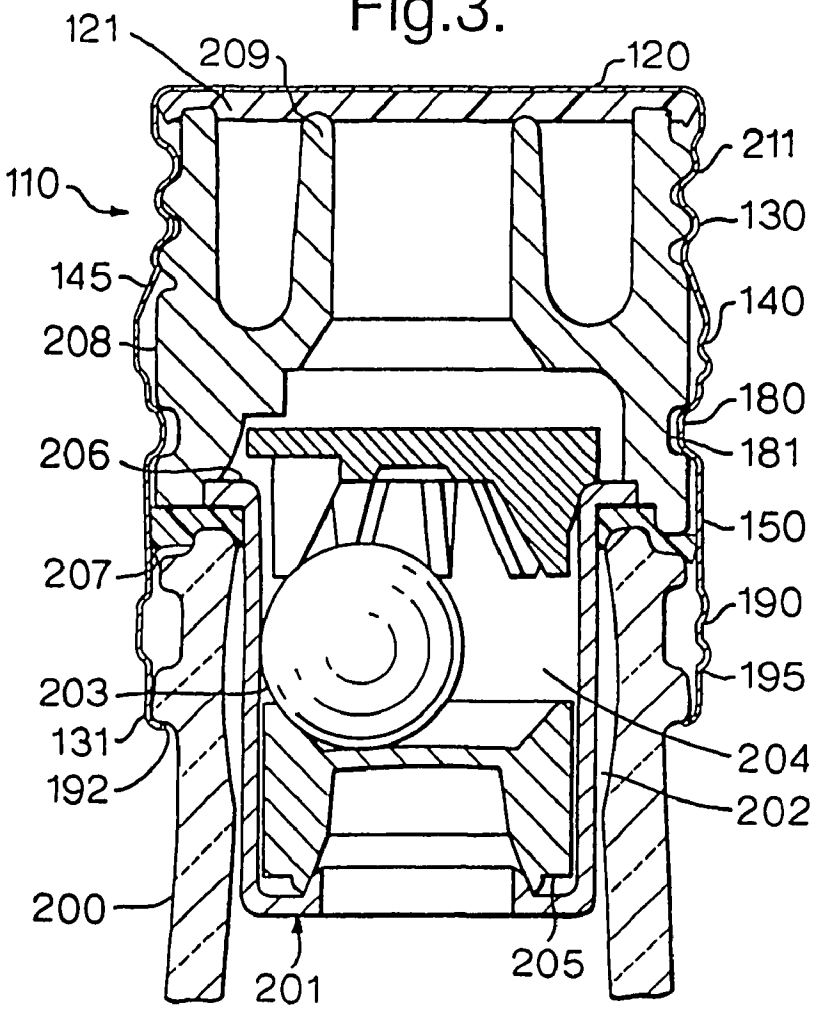
FIG. 3 is a section through a bottle neck shown fitted with a pouring fitment and closed by the closure of FIG. 2.

Referring now to FIG. 3, there is shown a bottle neck 200 and an in-bore non-return pouring fitment generally indicated 201 which is secured within the bottle neck and also within the closure 110. The pouring fitment 201 will be well known to those skilled in the art and comprises, briefly, a lower feed cylinder 202 which includes a one way valve arrangement involving a glass ball 203 held captive in a valve chamber 204 and a valve member 205 which is movable between a lower closed position and a raised open position. At the top of the feed cylinder 202 the fitment is flared at a shoulder 206 which is of a diameter greater than that of the bottle neck 200 so that the fitment is pushed into the bottle to the top of the feed cylinder and is sealed in the bottle neck using a silicone washer 207 or the like. Above the shoulder 206 a cylindrical upper section 208 of the fitment includes a pouring spout 209. The outside of the cylindrical upper section has two threads 211.

Just above the shoulder 206 the upper section 208 of the fitment has a circumferential retaining channel 181. In practice the fitment 201 is pushed into the closure 110 so that the dimples 180 of the closure engage into the retaining channel 181 of the fitment. The fitment/closure assembly is then applied together to the bottle neck and the closure is then "rolled on" to the fitment and the bottle neck. The technique of rolling on will be well known to those skilled in the art and involves passing the closure through a series of rollers in which the closure conforms to the shape of specific parts of the neck and the fitment where required. In this process the closure is pushed around the threads of the fitment as shown and in addition the free end 131 of the skirt is turned under the transfer bead 192 of the bottle neck. The top of the upper section 208 of the pouring fitment is sealed against the underside of the crown 120 of the closure by a sealing wad 121. The fitment 201 is now secured in the bore of the bottle neck by the closure 110.

Figure 4:
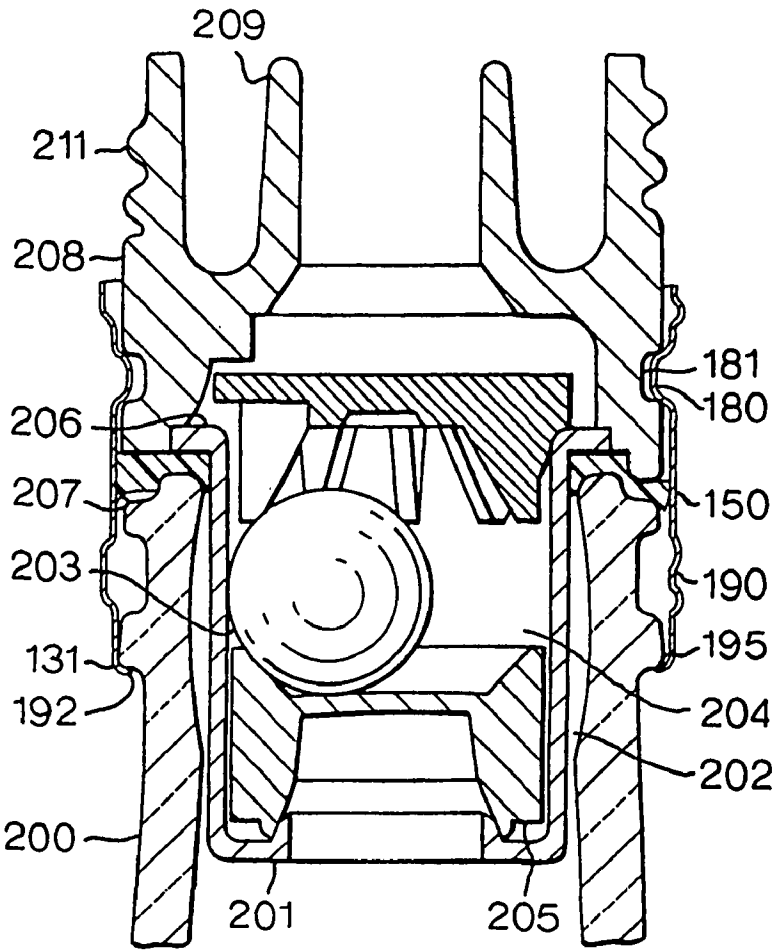
FIG. 4 shows the arrangement of FIG. 3 in which a first weakened zone has been broken on first opening of the closure.

Referring now to FIG. 4, the combination of the closure, pouring fitment and bottle neck is shown following first opening of the bottle top. In this process the upper top cap 145 is twisted off the bottle using the threads 211 and this breaks the frangible bridges 141 of the first circumferential line of weakening 140 so that the upper top cap 145 can be removed as shown. Whilst the top cap 145 can be replaced by screwing it back on the fitment threads 211 the frangible bridges 141 have been irreversibly broken and this separation is visibly obvious to indicate that the bottle has been opened.

As the bottle is first opened and the top cap 140 is removed the second circumferential line of weakening 190 is protected from breakage because there is no relative axial or rotational movement between the break band 150 and the break band 195.

Figure 5:
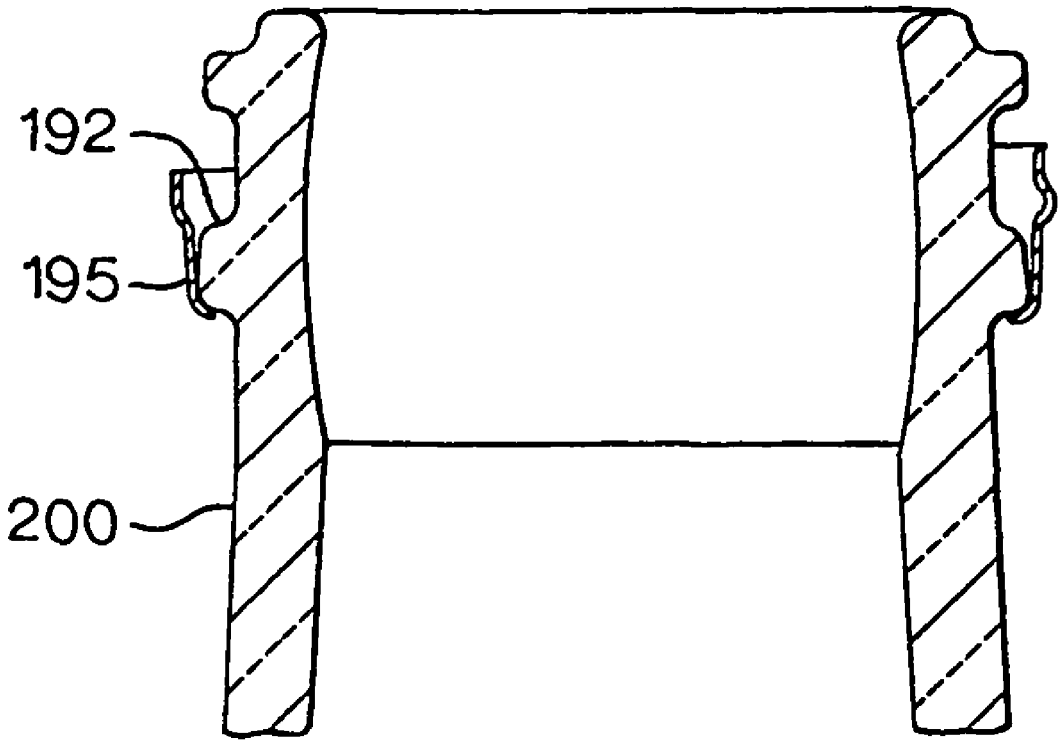
FIG. 5 shows the arrangement of FIG. 4 in which the pouring fitment has been removed.

An attempt may be made to remove the pouring fitment 201 from the neck of the bottle, for example in an attempt to bypass the one-way valve of the pouring fitment to re-fill the bottle. It will be seen that if the fitment is removed it will lift the break band 150 by virtue of the attachment via the dimples 180 and the channel 181. However, the second tamperevident break band 195 is held on the transfer bead 192 of the bottle so that if the fitment is removed the first break band 140 will be torn away from the second break band 195 due to breakage of the second circumferential line of weakening 190. As shown in FIG. 5, the second break band 195 remains on the neck 200 of the bottle as visual evidence that the pouring fitment has been removed.

Although a preferred embodiment of the invention has been specifically illustrated and described herein, it is to be understood that minor variations may be made in the apparatus without departing from the spirit and scope of the invention, as defined by the appended claims.

What is claimed is:

1. The combination of a closure and an in-bore fitment adapted for attachment to a container comprising a closure (110) and an in-bore fitment (201), the closure (110) including a crown (120) and a depending substantially tubular skirt (130) terminating at a lower peripheral edge portion (192), first means (140) for defining a substantially peripheral first weakened zone axially spaced from said crown (120) and setting-off therebetween a closure portion removable from said in-bore fitment (201) upon breakage along said first weakened zone (140) and further setting-off a first tamper evident peripheral skirt portion (150), second means (190) for defining a substantially peripheral second weakened zone between said first weakened zone (140) and said lower peripheral edge portion (192) and defining therewith a second tamper evident peripheral skirt portion (195), and said second weakened zone (190) being constructed and arranged not to break upon breakage of said first weakened zone (140) but thereafter breaking upon attempted removal of the in-bore fitment (201) from and associated container.

2. The combination as defined in claim 1 including a container (200) having a neck and said in-bore fitment (201) being located at least in part within a bore of said container neck.

3. The combination as defined in claim 1 wherein the fitment (201) is secured to the closure (110) between the first (140) and second (190) weakened zones.

4. The combination as defined in claim 1 wherein the fitment (201) is secured by an inward crimping (80) of part (150) of the skirt (130).

5. The combination as defined in claim 1 wherein the fitment is secured by an inward crimping (80) of the first tamper evident peripheral skirt portion (150).

6. The combination as defined in claim 1 wherein at least one of the first (140) and second (190) weakened zones is formed by a circumferential line of weakening.

7. The combination as defined in claim 1 wherein the second tamper evident peripheral skirt portion (195) is adapted to be secured to a container (200).

8. The combination as defined in claim 1 wherein at least one of the first (150) and second (195) tamper evident peripheral skirt portions is a circumferential band.

9. The combination as defined in claim 1 wherein the closure (110) is formed from metal.

10. The combination as defined in claim 2 wherein the fitment (201) is secured to the closure (110) between the first (140) and second (190) weakened zones.

11. The combination as defined in claim 2 wherein the fitment (201) is secured by an inward crimping (80) of part (150) of the skirt (130).

12. The combination as defined in claim 2 wherein the fitment is secured by an inward crimping (80) of the first tamper evident peripheral skirt portion (150).

13. The combination as defined in claim 2 wherein at least one of the first (140) and second (190) weakened zones is formed by a circumferential line of weakening.

14. The combination as defined in claim 2 wherein the second tamper evident peripheral skirt portion (195) is adapted to be secured to the container (200).

15. The combination as defined in claim 2 wherein at least one of the first (150) and second (195) tamper evident peripheral skirt portions is a circumferential band.

16. The combination as defined in claim 2 wherein the closure (110) is formed from metal.

* * * * *

US007121419C1

(12) INTER PARTES REEXAMINATION CERTIFICATE (0183rd)

United States Patent

Ferry et al.

(10) Number: US 7,121,419 C1

(45) Certificate Issued: Aug. 24, 2010

(54) CLOSURE

(75) Inventors: Andrew Ferry, Stirlingshire (GB); James McLennan, Fife (GB); David Senior, Perthshire (GB); John Sharpe, Scotland (GB)

(73) Assignee: Obrist Closures Switzerland GmbH, Reinach (CH)

Reexamination Request:
No. 95/000,359, Mar. 19, 2008

Reexamination Certificate for:

| | |
|---|---|
| Patent No.: | **7,121,419** |
| Issued: | **Oct. 17, 2006** |
| Appl. No.: | **10/473,154** |
| Filed: | **Sep. 29, 2003** |

(22) PCT Filed: Mar. 28, 2002

(86) PCT No.: PCT/EP02/03482

§ 371 (c)(1), (2), (4) Date: Sep. 29, 2003

(87) PCT Pub. No.: WO02/085730

PCT Pub. Date: Oct. 31, 2002

(30) Foreign Application Priority Data

Apr. 20, 2001 (EP) ..... 01303665

(51) Int. Cl.
*B65D 49/12* (2006.01)

(52) U.S. Cl. ..... 215/258

(58) Field of Classification Search ..... None
See application file for complete search history.

(56) References Cited

FOREIGN PATENT DOCUMENTS

GB 1 473 482 5/1977

*Primary Examiner*—Joseph A. Kaufman

(57) ABSTRACT

The combination of a closure (110) and an in-bore fitment (201) is provided for a container. The closure (110) comprises a generally plain crown (120) with a tubular skirt (130) depending from its periphery. The tubular skirt (130) has a first weakened zone (140) defining a first tamperevident portion (150); the first weakened zone (140) is adapted to break on first opening of the container. The tubular skirt (150) has a second weakened zone (190) defining a second tamperevident portion (150). The second weakened zone (190) is protected from breakage on first opening of the container but is arranged to break if an attempt is made to remove the in-bore fitment (201) from the container.

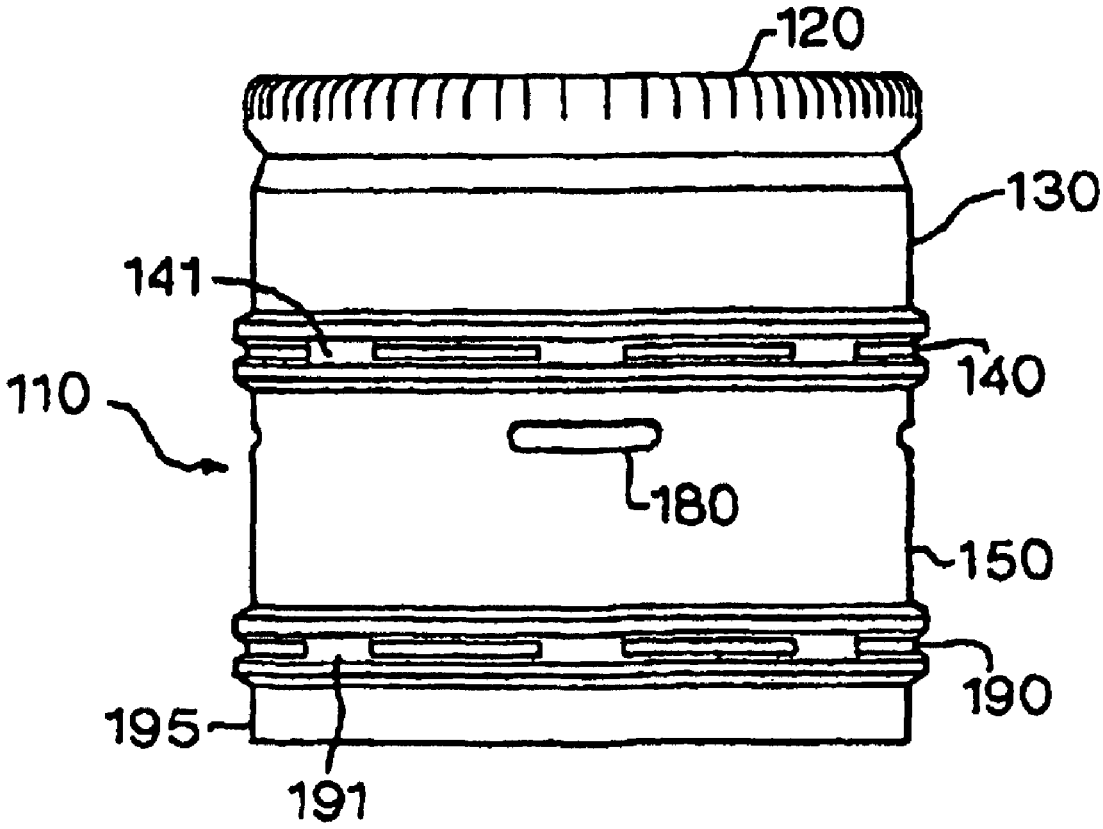

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1–16 are cancelled.

* * * * *